United States Patent [19]

Harper, Jr.

[11] 4,244,152

[45] Jan. 13, 1981

[54] JOINT FOR GEODESIC DOME

[75] Inventor: George C. Harper, Jr., Coraopolis, Pa.

[73] Assignee: Pittsburgh-Des Moines Steel Company, Pittsburgh, Pa.

[21] Appl. No.: 971,033

[22] Filed: Dec. 19, 1978

[51] Int. Cl.[2] ..... E04B 1/32

[52] U.S. Cl. ..... 52/81; 403/217

[58] Field of Search ..... 52/80, 81; 403/217, 403/218, 219; 85/36

[56] References Cited

U.S. PATENT DOCUMENTS

| | | | |
|---|---|---|---|
| 3,006,670 | 10/1961 | Schmidt | 52/81 |
| 3,192,669 | 7/1965 | Hawkins | 52/81 |
| 3,510,823 | 5/1970 | Cervenka | 85/36 |
| 3,563,581 | 2/1971 | Sommerstein | 403/217 |
| 3,635,509 | 1/1972 | Birkemeier | 52/81 |
| 3,914,063 | 10/1975 | Papayoti | 52/648 |
| 3,916,589 | 11/1975 | Richter | 52/81 |
| 4,099,888 | 7/1978 | Simone | 52/81 |

FOREIGN PATENT DOCUMENTS

| | | | |
|---|---|---|---|
| 27793 | 6/1884 | Fed. Rep. of Germany | 52/80 |
| 722310 | 5/1942 | Fed. Rep. of Germany | 403/218 |
| 51889 | 6/1920 | Sweden | 403/217 |
| 303397 | 1/1929 | United Kingdom | 403/217 |
| 423886 | 9/1942 | United Kingdom | 52/81 |

*Primary Examiner*—Price C. Faw, Jr.
*Assistant Examiner*—H. E. Raduazo
*Attorney, Agent, or Firm*—Shoemaker and Mattare, Ltd.

[57] ABSTRACT

A joint for use with a geodesic dome for connecting a plurality of struts together. The joint permits dome fabrication and erection with a minimum of field bolting. A central hub is included in the joint for resisting forces transmitted to the joint by dome struts.

6 Claims, 10 Drawing Figures

JOINT FOR GEODESIC DOME

BACKGROUND OF THE INVENTION

The present invention relates in general to roofs, and, more particularly, to geodesic or reticulated dome roofs.

Many tanks, such as storage tanks, or the like, use geodesic dome structures. These dome structures include a multiplicity of struts which are connected together. Heretofore, the interconnecting of the struts required a multiplicity of bolts and bolt-receiving holes. Loads on the domes include the dead weight of the structure, any wind pressure applied to the structure, and loads due to snow. The loads are transferred from the panels to the struts and from the struts through any means used to interconnect the struts.

The joint arrangements of the prior art structures involved substantial costs. In these prior art joint arrangements, many bolts and parts were used, and much bolting had to be done in the field. Such field assembly has many drawbacks. First, expenses involved in field assembly far exceed expenses involved in shop assembly. Second, in a shop, jigs, fixtures and the like can be employed in the assembly process, and assembly-line type procedures can be established. Such advantages are not practical in the field. Thus, as much assembly as possible should be carried out in a shop.

There is thus a need for a structure which can be quickly and easily erected which utilizes joints which can have a great deal of fabrication and assembly carried out in a shop.

The prior art structures also have suffered from a drawback arrising because beam stresses and forces are not satisfactorily handled. With the prior art connections, the beams connected to a connector tend to move independently and may even cause distortion of some parts of the prior art joints.

There is thus a need for a dome joint structure which will distribute and resist stresses and forces better than the prior art structures.

It is also noted that domes may have a tendency to deform or buckle under loading. The loading can be caused by snow, or the like. There is thus need for a structure which can be quickly and easily fabricated and assembled, with as much of the work as possible being carried out in a shop, and which can be used to resist dome buckling and/or deformation under loading.

SUMMARY OF THE INVENTION

The dome assembly embodying the teachings of the present invention is easily and simply assembled and erected with a minimum of field assembly and bolting being required.

The system embodying the teachings of the present invention comprises a reticulated dome frame which is fully clad. A shell has a curved surface composed of a single layer of prismatic structural elements whose positions coincide with a regular pattern of divisions of the surface. The surface of the disclosed dome encloses a segment of one base of a sphere, and includes straight wide flange members as prismatic structural elements arranged in a pattern of divisions producing triangular elements of surface area. Light gauge metal sheeting is used for surface cladding. This joint would be suitable for a variety of space frame geometries and structural element sections.

A plurality of dome struts are connected to a single hub connector, and a plurality of hub connectors are included. The hub connectors provide a quick, easy connection during assembly operations of the struts to the hub point. The design is such that it: accommodates compressive stresses from the struts; transmits bending moments from the struts through the hub point; resists snap-through buckling; provides for change in slope of the struts with respect to the hub point; provides for easy horizontal orientation of the strut with respect to the hub point; provides for attachment of a sealing cover over the hub point and for attachment of temporary lifting devices to facilitate erection.

A tension ring is also included to attach the dome to a structure. The tension ring utilizes hub connectors similar to those used throughout the rest of the dome. The tension ring allows erection of the structure in a manner which is greatly simplified as compared to the prior art domes, and requires no welding. Shop fabrication can be performed with tools common to most steel fabricating facilities.

OBJECTS OF THE INVENTION

It is therefore a main object of the present invention to provide a joint for a geodesic dome which is easily and quickly assembled and erected.

It is another object of the present invention to provide a joint for a geodesic dome which can be assembled and fabricated with a minimum of field assembly and/or fabrication being required.

It is yet another object of the present invention to provide a joint for a geodesic dome which is constructed with a minimum of bolting being required.

It is a further object of the present invention to provide a joint for a geodesic dome which can be assembled without requiring welding.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
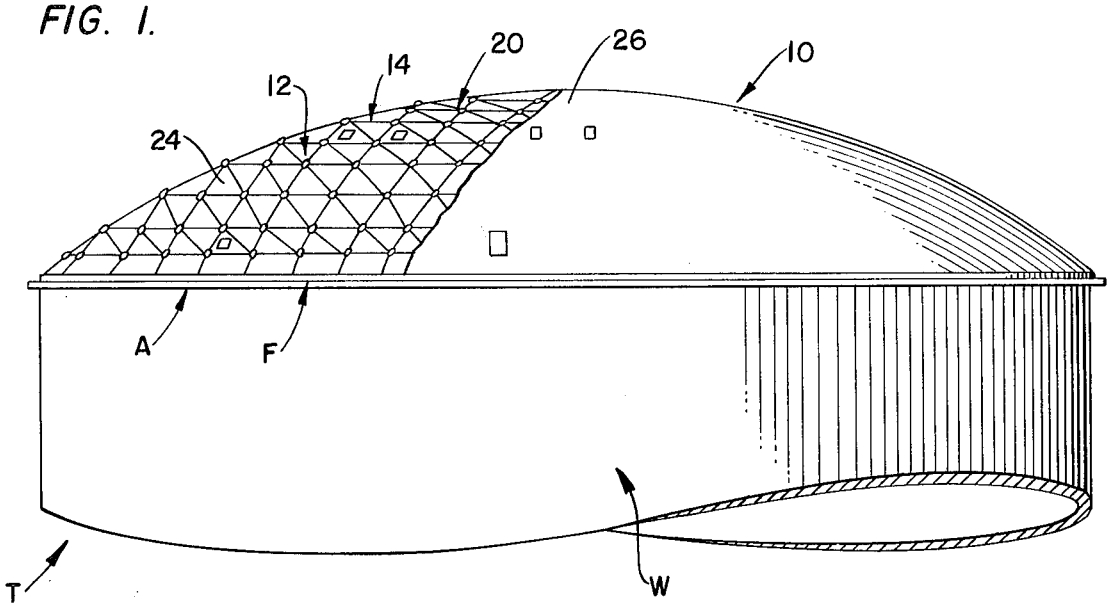
FIG. 1 is an elevation view of a tank utilizing a geodesic roof utilizing the joints embodying the teachings of the present invention.
Figure 2:
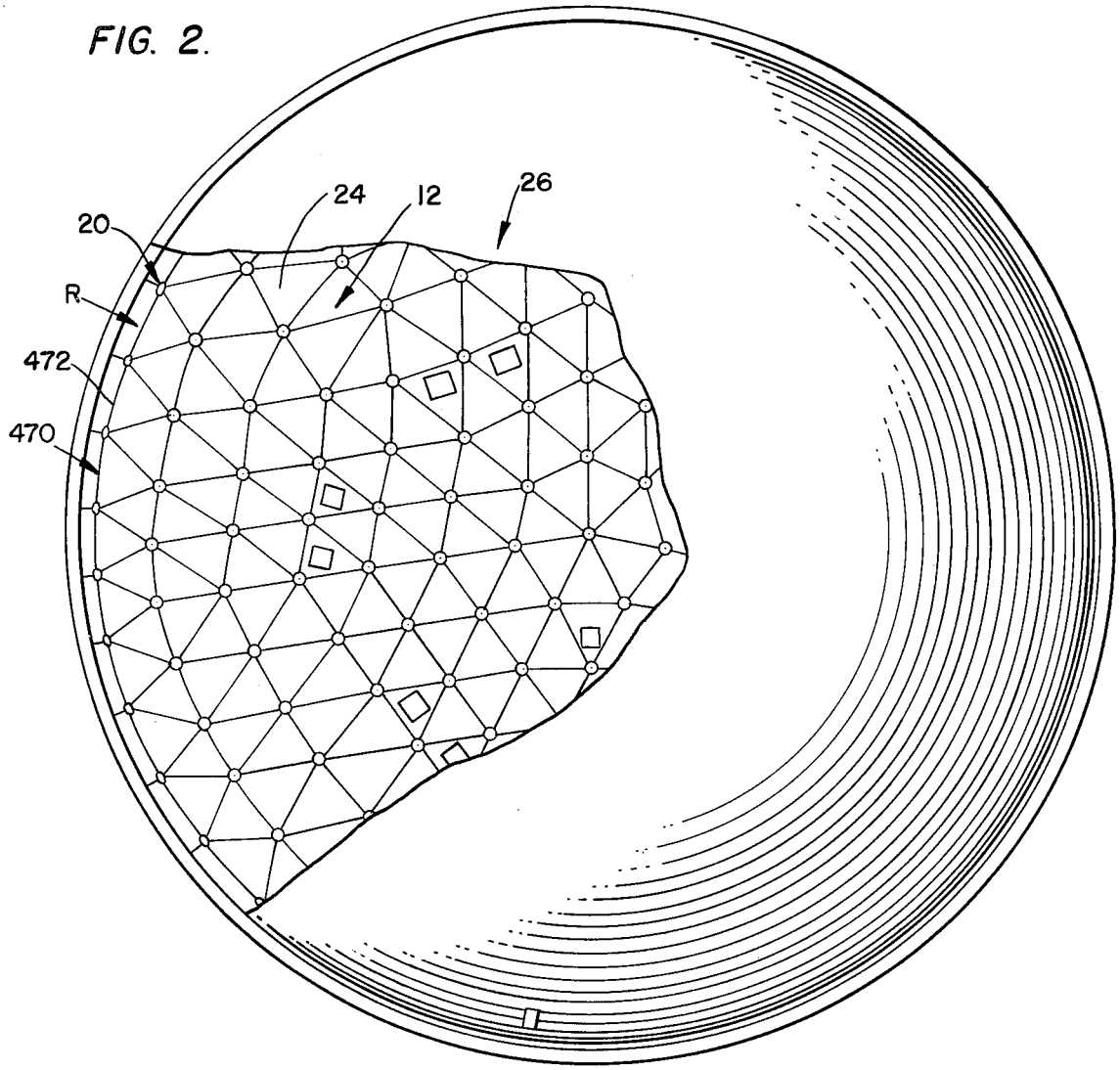
FIG. 2 is a partially cut away plan view of a geodesic dome utilizing a joint embodying the teachings of the present invention.

Shown in FIGS. 1 and 2 is a tank T having a wall structure W and a geodesic dome 10 functioning as the roof of the tank. The dome 10 is a simple, lightweight, easily erected, self-supporting structure which can be installed over petroleum storage tanks, sewage treatment facilities, and the like.

The dome 10 is arcuate and is supported on the wall top rim A in a manner which will be subsequently described. The dome includes a multiplicity of sectors 12 each defined by beams or struts 14 which are connected together by joint connectors 20 and each of which includes a panel 24. Cladding 26 covers the struts and panels, and a peripheral flange F can surround the roof.

Figure 3:
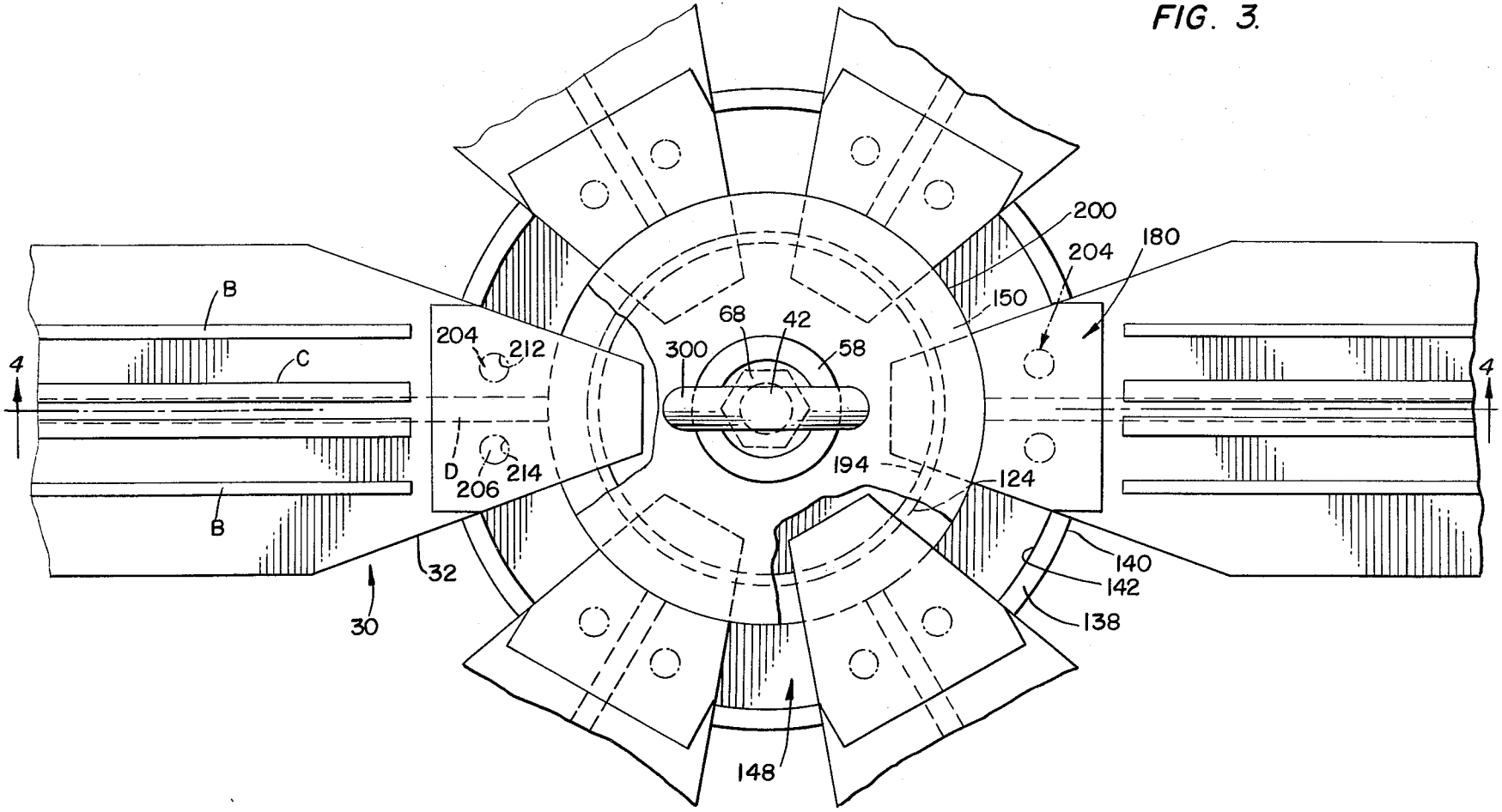
FIG. 3 is a plan view of a connector embodying the teachings of the present invention.
Figure 4:
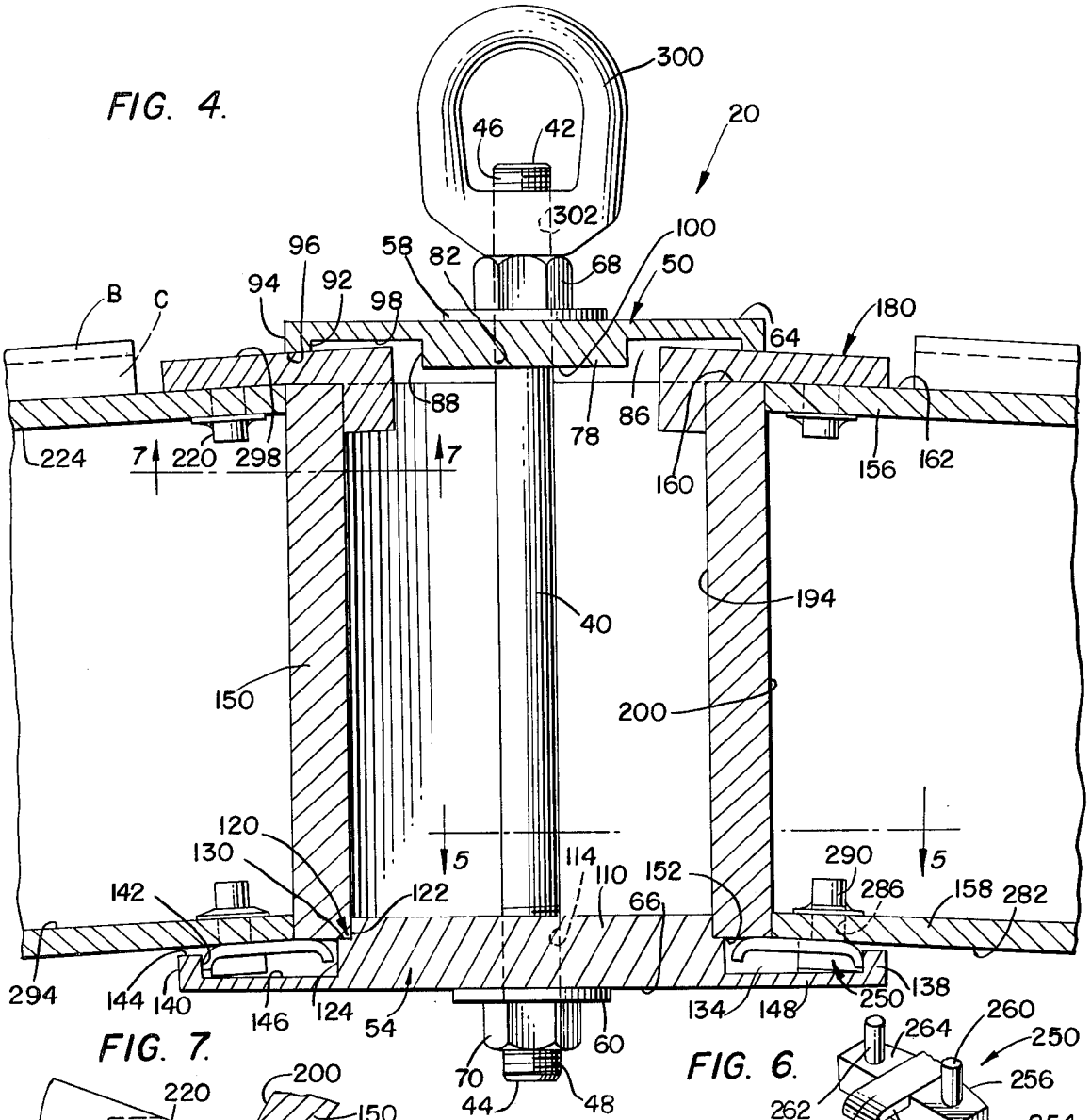
FIG. 4 is a view taken along line 4—4 of FIG. 3.

One of the joint connectors 20 is best shown in FIGS. 3 and 4, and attention is now directed to those Figures. Each strut is in the form of an I-beam and includes top flanges B and C, a central longitudinal web D, and an end portion 30 which has been configured, by milling or the like, to be accommodated by an arcuate connector. The struts radiate outwardly from the connector, and, as the dome is arcuate, the struts will slope slightly downward from the connector (see FIG. 4); thus, the shape of the end portion 30 of the struts having inwardly converging sides 32 which form a truncated triangle will enable each of the struts to be most effectively attached to appropriate joint connectors 20. Sealant (not shown) and flashing (not shown) can also be included and attached to the joint connector.

As best shown in FIG. 4, each connector 20 includes a central bolt 40 having ends 42 and 44 each having external threads 46 and 48, respectively, thereon. A top plate 50 and a bottom plate 54 are mounted on the bolt 40 and washers 58 and 60 seated on the bolt between the outer surfaces 64 and 66 of the plates and fasteners, such as nuts 68 and 70, respectively, hold the plates on the bolt. It is here noted that the terms "top" and "bottom" are used for illustrative purposes only and are not in any way intended to be limiting.

Each plate of the connector is substantially circular as shown in FIG. 3, and the top plate has a boss 78 defined centrally thereof through which a bore 82 is defined to accommodate the bolt 40. An annular channel 86 is defined between the outer periphery 88 of the boss 78 and a peripheral flange 92 of the top plate. The flange 92 has an outer surface 94, and extends downwardly in the FIG. 4 position of the connector, and has an inner rim 96 thereon. The inner rim 92 can be sloped with respect to the inner surface 98 of the channel to accommodate the slope of the struts attached to the connector, and located above the plane defined by the interior surface 100 of the boss 78, that is, the plane of the rim 92 is located between the planes 98 and 100 of the channel web and the boss interior surface, respectively.

The bottom plate 54 has a central boss 110 through which a bore 114 is defined to receive the bolt 40. The boss 110 has a stepped outer periphery with a shoulder 120 defined thereon. The shoulder has an inner upright surface 122 and an outer upright surface 124 defining a horizontal ledge 130 therebetween. An annular channel 134 is defined between the surface 124 and an outer peripheral flange 138 on the plate 54. The flange 138 has an outer surface 140 and an inner surface 142, and extends upwardly in the FIG. 4 position of the connector and has an inner rim 144 thereon. The plane containing the inner rim 144 is located above the plane containing interior surface 146 of the web 148 defining the channel 134, and below the plane containing ledge 130.

A cylindrical, tubular hub 150 has the lower end thereof 152 seated on the ledge 130, and extends upwardly therefrom to span a corresponding strut between strut upper and lower flanges 156 and 158, respectively. The hub 150 has an upper surface 160 which is essentially coplanar with upper surface 162 of the strut top flange, and can be sloped to correspond to the slope of the strut, if so desired.

Figure 7:
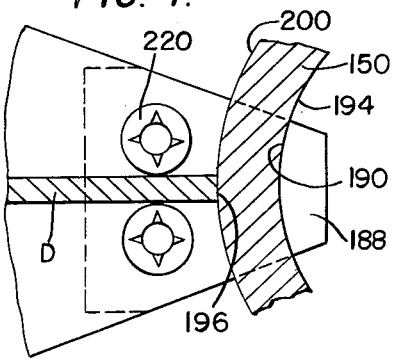
FIG. 7 is a view taken along line 7—7 of FIG. 4.
Figure 8:
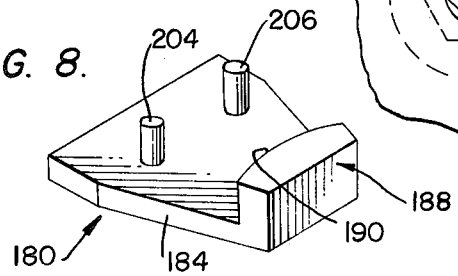
FIG. 8 is a perspective of a fastener used in the connector shown in FIG. 4.

Each strut has an end connector 180 thereon which is interposed between the hub upper surface 160 and the rim surface 96 as best shown in FIG. 4. An end connector 180 is shown in FIG. 8, and each end connector includes a base plate 184 which has an integral projection 188 on one end thereof. The projection 188 has a curved surface 190 thereon which has a curvature corresponding to the curvature of the hub 150. The corresponding curvatures permit the projection 188 to fit snugly against the hub inner surface 194 as best shown in FIG. 7. As also shown in FIG. 7, the inner end 196 of the central web D can be, if so desired, transversely curved to permit that end to fit snugly against outer surface 200 of the hub and thereby capture that hub between the web D and the projection 188. A pair of pins 204 and 206 are integral with the base plate 184 and extend downwardly therefrom in the FIG. 4 orientation in the direction of the projection 188. The end connector shown in FIG. 8 is integral and unitary.

Each strut has a pair of pin-receiving bores 212 and 214 respectively (FIG. 3) to receive the pins 204 and 206 therethrough. Fasteners, such as speed nuts 220, fit over the ends of the pins and engage the inner surface 224 of the strut upper flange to thereby attach the hub to the strut flange.

Figure 6:
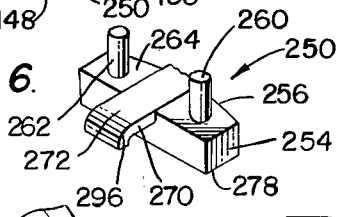
FIG. 6 is a perspective of a fastener used in the connector shown in FIG. 4.

As shown in FIG. 4, fasteners 250 are accommodated in channels 138 of the bottom plate. A fastener 250 is best shown in FIG. 6, and includes a body 254 having a curved outer surface 256 and a pair of integral pins 260 and 262 extending outwardly from the body from upper surface 264 thereof. A shim clip 270 is mounted on the body in a channel defined transversely of the body so that upper surface 272 of the shim clip is essentially coplanar with upper surface 264 of the body. The upper surface of the body 254 is essentially parallel with lower surface 278 thereof, thereby causing that lower surface to be sloped with respect to inner surface 146 of the channel web 148 when the upper surface 264 is engaged against lower surface 282 of the strut flange 158. The shim upper surface is also flushly engaged against the strut lower surface 282 when the body upper surface 264 is flushly engaged thereagainst as shown in FIG. 4.

Figure 5:
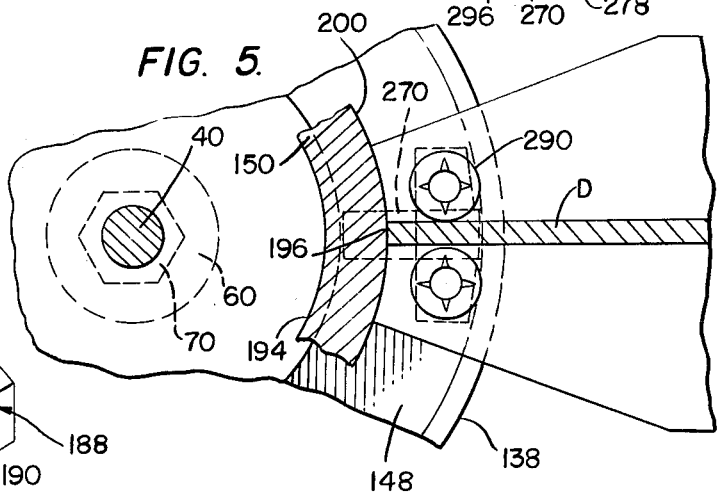
FIG. 5 is a view taken along line 5—5 of FIG. 4.

Each strut lower flange has pin-receiving holes 268 defined therein through which the pins 260 and 262 extend. Fasteners, such as speed nuts 290, or the like, fit over the ends of the pins and engage the inner surface 294 of the strut lower flanges to attach the fasteners 250 to that strut. Distal end 296 of each shim is curved and has an upper surface flushly abutting the lower surface 152 of the hub 150, and the fastener 250 is seated on the bottom plate 54. As shown in FIGS. 4 and 5, the inner end 196 of the web D can be transversely curved to permit that end to snugly fit against the hub outer surface 200 and thereby capture that hub between that end and the surface 122 of the boss 110.

When the nuts 68 and 70 are tightened against the plates 50 and 54, those plates are moved longitudinally of the bolt 40 thereby seating rim surface 96 against upper surface 298 of the end connectors and the web inner surface 146 against fasteners 250. The upper surfaces 264 and 272 of the fasteners 250 are engaged against the strut lower flange surfaces 282 and the lower surface 152 to thereby securely connect the struts and hub to the connector 20. The top and bottom plates are clamped to the hub by means of the single bolt 40 through the center of the hub holding these plates in their final positions.

During erection, bottom plate 54 could be attached to an erection support tower, and then properly positioned. After the joint is clamped with the center bolt 40, the joint and the assembly can then be raised into the final position.

All components can be of aluminum, stainless steel or carbon steel, plain or galvanized, or there could be a combination of these materials. Further, the structure could be built of fiberglass components, or other plastic materials.

Other forms of the upper and lower plates can be used, and a cover member can also be included to span the connector. Such a cover member would be connected to the struts on top surfaces 162 and cover the bolt end 42. Furthermore, the bolt 40 can be replaced by a pair of bolts, each being accommodated in either the top or bottom plate. A yoke-like connector can be used in place of the end connector and would be located on both the top and bottom of the connector 20.

The various parts of the connector can be shop fabricated and field assembled. Attachment of the various parts of the joint assembly can be accomplished in the fabricating shop. Field assembly comprises orienting the strut so that one of the parts engages the top of the hub cylinder, and another part bears against the bottom of the hub cylinder and the entire assembly is clamped into place by tightening the bolt 40 to engage yet another part.

The function of hub 150 can best be understood by referring to FIG. 4. At a connector there are a plurality of beams converging (see FIG. 3) and are all connected to the joint connector. Other than the hub, there is no structure tieing the top and bottom flanges of each strut together, thus, there is no element, other than the hub, to resist shear. Thus, for example, if forces urge one beam to move radially with respect to the joint, unresisted forces in the joint may occur. However, due to the presence of the hub 150, all of the beams, or struts, are tied together by that hub. Thus, if loading tends to urge one beam to move radially with respect to the hub, the forces tending to cause that radial movement are transferred through the hub.

The hub also accommodates shear. By considering a single beam, it is seen that there is an axial load, a moment trying to bend the beam about the strong axis thereof, a moment trying to bend the beam about the weak axis thereof, and shear forces on the ends of that beam. Moments are carried by the fasteners into the end plates, then onto the structure. The shear is taken into ledge 130 and then into the hub 150 and effectively resisted.

A lifting eye 300 has a threaded bore 302 and is threadably engaged on the bolt 40 to temporarily attach that lifting eye to the connector 20. The lifting eye is connected to a lifting device to lift the roof, with the struts attached to the connector, into position over tank T, and then is disconnected from the connector.

A dome 10 resting on top of tank T is subject to several loads, such as snow loading, for example, which tends to flatten out the dome. That is, the top of the dome tends to move down, and the peripheral edge thereof tends to move radially outward. Without sufficient structural support, the dome may tend to flatten and possibly buckle. This flattening tendency can be resisted by absorbing the forces that tend to move the peripheral edge radially outward. If the edge is held in place, the top of the dome cannot deflect to any significant degree.

The dome 10 includes a tension ring R which functions to resist outward movement of the peripheral edge of the dome 10, and is in the form of a continuous circle. The tension ring R includes joints to which the beams are attached. The joints of the tension ring are similar to those joints discussed above. Thus, the joints used in the tension ring can be shop fabricated and shop assembled. There is thus a minimum of field assembly and fabrication required for the tension ring, thereby giving the tension ring the above-discussed advantages.

Figure 9:
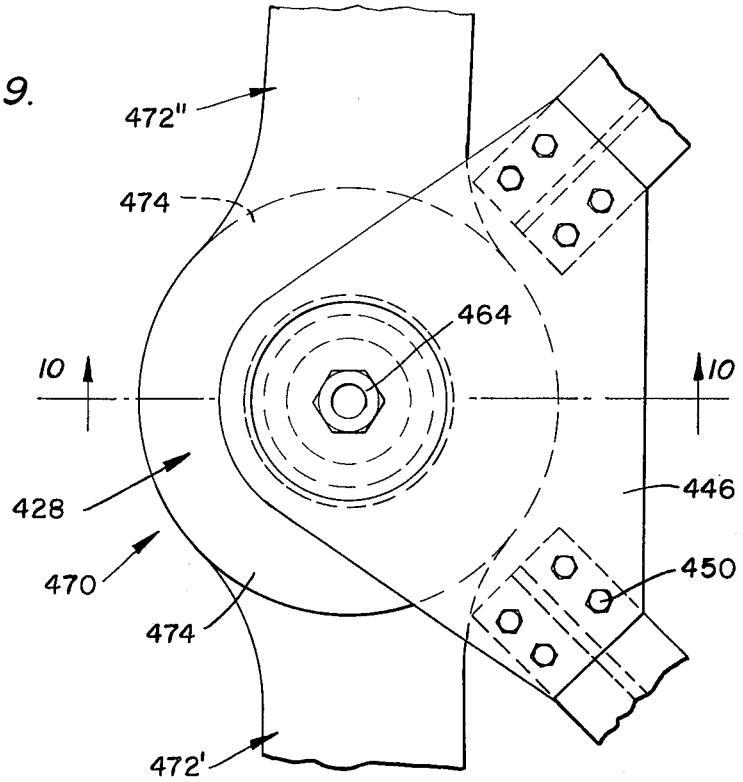
FIG. 9 is a plan view of a tension ring used in a geodesic dome.
Figure 10:
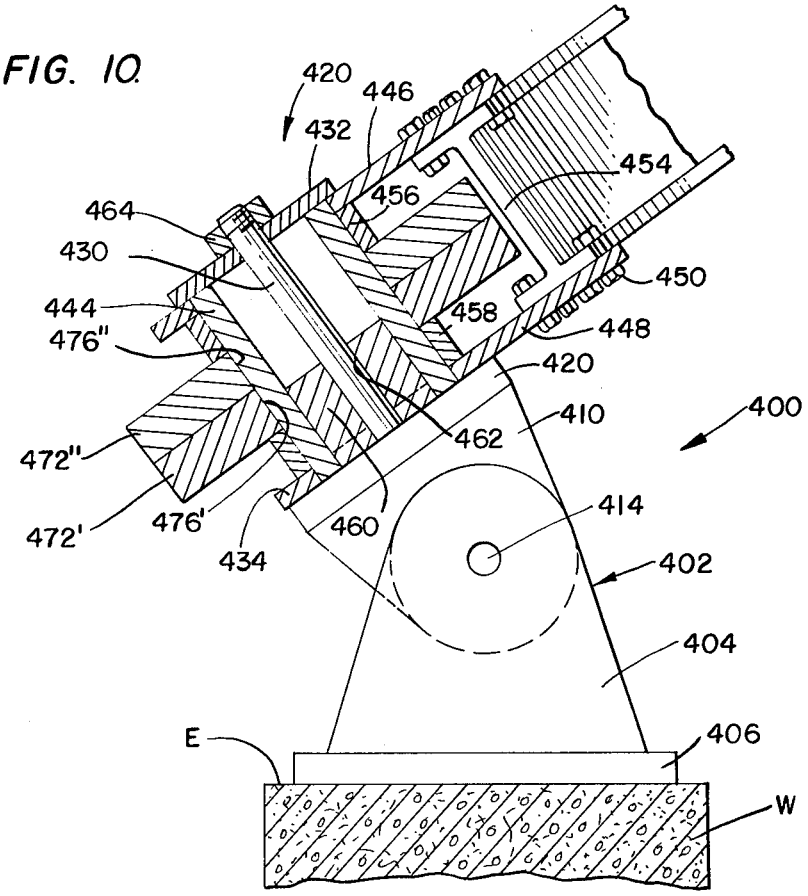
FIG. 10 is a view taken along line 10—10 of FIG. 9.

A wall mounting 400 for connecting the dome struts to the tank wall W is best shown in FIGS. 9 and 10. The wall mounting 400 includes a trunion-like pedestal 402 which has a lower base 404 mounted on top rim E of wall W by a base plate 406 and an upper base 410 pivotally connected to the lower base by a pivot pin 414. The upper base 410 has a mounting plate 420.

A joint connector 428 is mounted on the mounting plate 420 and includes an anchor bolt 430, and a pair of closure plates 432 and 434 on the anchor bolt. A hub 444 forms a tubular body and operates and functions in a manner similar to the hub 150.

The strut flanges have gusset plates 446 and 448 attached thereto by a plurality of fasteners, such as bolts 450, and a strut end cap 454 is on each strut. Arcuate spacer plates 456 and 458 are also included on the connector, and surround the hub. Flashing plates can also be attached to the connectors 428.

The spacer plates preferably have a curvature matching that of the tubular hub 444. A plug 460 has a bolt-receiving bore 462 defined therein and is located within the hub 444. The hub is trapped between the plates 432 and 434 and bears against the plug 460 to accommodate forces in a manner similar to the ledge 130 of the FIG. 4 joint. The lower plate 434 can be attached to plate 420 in any suitable manner, and/or the bolt 430 can be attached to the plate 420 in any suitable manner to mount the joint 428 on the pedestal 402.

Suitable fastening means, such as a nut 464 threaded onto the bolt 430, can be used to secure the plates 432 and 434 against the hub 440. The plates 432 and 434 are substantially circular and essentially planar and the lower surface of the top plate 432 bears against the upper ends of the hub. The lower plate can have an arcuate channel 466 defined therein for receiving and accommodating the hub so the lower ends of that hub contact the upper surface of the mounting plate 420 as shown in FIG. 10.

As shown in FIGS. 2, 9 and 10, a ring-like element 470 interconnects the mountings 400 around the outer periphery of the dome. The ring-like element comprises a plurality of chain-like elements 472 which are connected together at the connectors 428. The elements 472 are preferably in the form of I-beams with connecting ends 474 thereon. For example, as shown in FIGS. 9 and 10, elements 472' and 472'' each has a connecting end thereon which has a hub receiving hole 476' and 476'', respectively, defined therein, and is preferably attached to the tubular hub 440.

In assembly the gusset plates are positioned as indicated in FIG. 10 with spacers therebetween, and the plates 432 and 434 drawn down to securely capture the gusset plates in the FIG. 10 position.

As shown, the gusset plates can attach a pair of struts to a single connector when the struts are at an angle with respect to each other.

A connector 428 is located at each of the panel points around the base of the dome. The chain elements of the tension ring R can be fabricated either by forging aluminum, stainless steel, or carbon steel, or can be burned from any of these materials. The connectors also accommodate dome sheeting material.

It is noted that loads applied to the tension ring are applied at the centroid of the ring with no discontinuity of forces to cause secondary stresses.

As shown in FIG. 9, a single gusset plate serves as a connector for two adjacent struts. The common gusset plate embodiment simplifies fabrication and construction. An alternative embodiment of the tension ring can include a gusset plate for each strut.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A joint connector for use in space frames to connect a plurality of struts together, comprising:

a central bolt;

top and bottom plates slidably mounted on said central bolt;

an integral cylindrical, tubular hub surrounding said central bolt and located between said plates;

means on said central bolt for forcing said plates together to secure said hub between said plates;

fastening means for connecting struts to said hub so that shear forces and radial forces from such struts are transmitted to said hub, said fastening means including a gusset plate attached to a pair of struts which are oriented at an angle with respect to each other;

arcuate spacer plates; and a tension ring, said tension ring including a plurality of chain-like elements each pivotally connected to a hub, said chain-like elements being connected to hubs in pairs with each pair having one chain-like element disposed above the other chain-like element.

2. The joint connector defined in claim 1 further including a pedestal mounting the joint connector onto a wall.

3. The joint connector defined in claim 2 wherein said pedestal includes an upper and a lower base pivotally connected together.

4. The joint connector defined in claim 3 wherein said bottom plate has an arcuate channel defined therein into which a lower end of said hub is accommodated.

5. The joint connector defined in claim 4 wherein said top and bottom plates are substantially circular and essentially planar.

6. The joint connector defined in claim 5 further including a plug having a central bore for receiving said central bolt, said plug being located within said hub near said bottom plate.

* * * * *